US007867055B2

(12) United States Patent
Todokoro

(10) Patent No.: US 7,867,055 B2
(45) Date of Patent: Jan. 11, 2011

(54) SOUNDING TOY

(75) Inventor: Masatoshi Todokoro, Tokyo (JP)

(73) Assignee: Agatsuma Co., Ltd., Tokyo (JP)

( * ) Notice: Subject to any disclaimer, the term of this patent is extended or adjusted under 35 U.S.C. 154(b) by 1433 days.

(21) Appl. No.: 11/296,481

(22) Filed: Dec. 8, 2005

(65) Prior Publication Data

US 2006/0246814 A1 Nov. 2, 2006

(30) Foreign Application Priority Data

May 2, 2005 (JP) ..... 2005-002878

(51) Int. Cl.
*A63H 5/00* (2006.01)

(52) U.S. Cl. ..... 446/81; 446/199

(58) Field of Classification Search ..... None
See application file for complete search history.

(56) References Cited

U.S. PATENT DOCUMENTS 4,945,805 A * 8/1990 Hour ..... 84/610
5,218,580 A * 6/1993 Okamura et al. ..... 369/2
5,270,480 A * 12/1993 Hikawa ..... 84/645
5,541,359 A * 7/1996 Lee ..... 84/645
5,541,999 A * 7/1996 Hirai ..... 381/2
5,719,344 A * 2/1998 Pawate ..... 84/609
5,784,467 A * 7/1998 Asayama ..... 381/17
6,025,553 A * 2/2000 Lee ..... 84/610
6,524,157 B1 * 2/2003 Ryan ..... 446/299
2003/0026595 A1 * 2/2003 Ikeda ..... 386/96

FOREIGN PATENT DOCUMENTS

JP 06250683 A * 9/1994
JP 09311688 A * 12/1997
JP 2003-079963 3/2003
JP 2003-108164 4/2003

* cited by examiner

*Primary Examiner*—Ronald Laneau
*Assistant Examiner*—Tramar Harper
(74) *Attorney, Agent, or Firm*—Bingham McCutchen LLP

(57) ABSTRACT

In order to provide a never boring toy which moves to the singing voice or accompaniment music and which people can enjoy karaoke, the present invention provides a sounding toy having a driving mechanism which has a sound synthesizing device and loudspeakers which are integrated with the toy in the interior thereof and a sound mixing circuit provided in the sound synthesizing device, the loudspeaker and a handy microphone are connectable to the sound synthesizing device, wherein in the sound mixing circuit, an analog signal inputted from a microphone terminal and an analog signal inputted from the audio terminal are superimposed in a mixer circuit and are amplified from the loudspeaker put into foot parts of the toy through a main amplifier, and then a driver applies a voltage to a power source of the driving mechanism and the toy is operated by the driving mechanism.

43 Claims, 11 Drawing Sheets

SOUNDING TOY

BACKGROUND OF THE INVENTION

1. Field of the Invention

The present invention relates to a sounding toy which has a sounding device in the interior thereof and moves to the sound.

2. Background Art

Nowadays, there is a doll which moves by the action of a sensor for example described in Japan Patent Publication No.2003-79963.

This invention provides a singing doll that a control device is operated and a music is presented for a specified period of time by the action of a sensor, at the same time, the body of the doll is made to swing in the lateral direction by a motion mechanism constructed a driving mechanism and a connection mechanism, and the expression of the face is changed.

According to this invention, people can enjoy looking at the doll because the doll starts to move by detecting human's movement etc., moves to the music, and changes the expression of the face.

Also, there is a portable karaoke device comprising a handy microphone and a speaker unit, players can enjoy karaoke by singing to the music stored in a sound memory device etc. of the karaoke device.

Japanese Patent Publication No.2003-108164 (Japanese Patent Application No.2001-300372) is given as an example of the karaoke device. The karaoke device of this invention comprises a handy microphone of a size graspable by one hand and a speaker unit integrated with the handy microphone, wherein a memory device which stores accompaniment music is incorporated or is exchangeably set into the microphone and a circuit having a mixer circuit which synthesizes a singing voice of player and accompaniment music is incorporated into the microphone.

According to this invention, people can enjoy karaoke anywhere she or he likes without an output device such as a television set, and also can enjoy karaoke with a video picture by using the output device.

As described above, dolls which move to the music are goods which can be only enjoyed looking at the comical movement, and portable karaoke devices are provided on purpose to sing to accompaniment or to look at the video picture with singing.

SUMMARY OF THE INVENTION

As described above, a doll which gives fun or enjoyment by making a sound and showing its movement bored often when it only makes the sound and moves on the same conditions.

Then, it is an object of the invention to provide a never boring toy which moves to the singing voice or accompaniment music and which people can enjoy karaoke.

To solve this object, the present invention provides a toy having a driving mechanism which has a sound mixing circuit and loudspeakers in the interior thereof and has a microphone terminal which can make a microphone connect to the sound mixing circuit and an audio terminal which can make an analog signal generator connect to the sound mixing circuit; wherein in the sound mixing circuit, a sound analog signal inputted from the microphone terminal is amplified in a first amplifier and an analog signal inputted from the audio terminal is amplified in a second amplifier, and then above two analog signals are superimposed in a mixer circuit and are amplified from the loudspeaker through an output-controllable main amplifier; an output terminal of the mixer circuit is connected to a driver as well as to the main amplifier, the driver applies a voltage to a power source of the driving mechanism when the analog signals are inputted from the mixer circuit and the toy is operated by the driving mechanism.

Accordingly, the voice of a singer inputted from the microphone and accompaniment music inputted from the audio terminal may be amplified from the loudspeaker, and the driving mechanism may be operated to this amplified sound.

Therefore, people can enjoy not only singing with karaoke but also looking at the toy which presents the voice of a singer and accompaniment music and moves to the sound.

Also, the feature of the present invention is that the driving mechanism has a motor as a drive source in the interior thereof.

Therefore, designing and production of the driving mechanism can be easier.

Another feature of the present invention is that a vocal canceller is provided in between the second amplifier and the mixer circuit.

Accordingly, an only voice area of a singer can be deleted from the analog signal amplified in the second amplifier in the vocal canceller.

Therefore, a sounding toy which people can easily enjoy karaoke is provided since a stocked audio data including a singing voice of singers can be used as the audio data without preparing an audio data for karaoke.

And another feature of the present invention is that an effector is provided in between the first amplifier and the mixer circuit.

Accordingly, a vocal quality of the analog signal of singer inputted from the microphone can be changed.

Therefore, a sounding toy which people can much enjoy karaoke is provided since the vocal quality of singer can be changed.

Also, another feature of the present invention is that the loudspeaker is put into foot parts of the toy.

Accordingly, the loudspeaker can be incorporated into the toy in the shape as it is without a disadvantage such the shape has to be changed when the loudspeaker which is a relatively big part is incorporated into such as the main body.

Therefore, designing and production of the position of loudspeaker can be easier and the loudspeaker may be easily set with the driving mechanism.

And another feature of the present invention is that an imaging device and a video signal forming circuit are incorporated into the toy, wherein the video signal forming circuit outputs a picture signal inputted from the imaging device to a monitor terminal as a video signal.

Accordingly, a figure of singer etc. maybe projected into a monitor.

Therefore, the mood of karaoke may be aroused by the figure of singer being projected into the monitor.

Also, another feature of the present invention is that the sound mixing circuit has a sound memory.

Therefore, a sounding toy which people can enjoy karaoke without an external sound source is provided by storing an audio data for accompaniment music in the sound memory.

And another feature of the present invention is that an audio data such as a character's voice, applause and handclap is stored in the sound memory.

Therefore, a sounding toy which people can much enjoy karaoke is provided since a sound to arouse the mood to the singing such as applause is amplified.

DESCRIPTION OF THE PREFERRED EMBODIMENT

The present invention provides a sounding toy having a driving mechanism which has a sound synthesizing device and loudspeakers which are integrated with the toy in the interior thereof; the sound synthesizing device has a sound mixing circuit into the interior thereof and the sound mixing circuit has a microphone terminal which a handy microphone is connectable to and an audio terminal which an analog signal generator is connectable to, the loudspeaker and the handy microphone are connectable to the sound synthesizing device; wherein in the sound mixing circuit, an analog signal inputted from the microphone terminal is amplified in a first amplifier and is transformed in an effector, also an analog signal inputted from the audio terminal is amplified in a second amplifier and a wavelength of human vocalization zone is deleted in a vocal canceller, and then above two analog signals are superimposed in a mixer circuit and are amplified from the loudspeaker put into foot parts of the toy through an output-controllable main amplifier. An output terminal of the mixer circuit is connected to a driver as well as to the main amplifier, the driver applies a voltage to a power source of the driving mechanism and the toy is operated by the driving mechanism.

Figure 1:
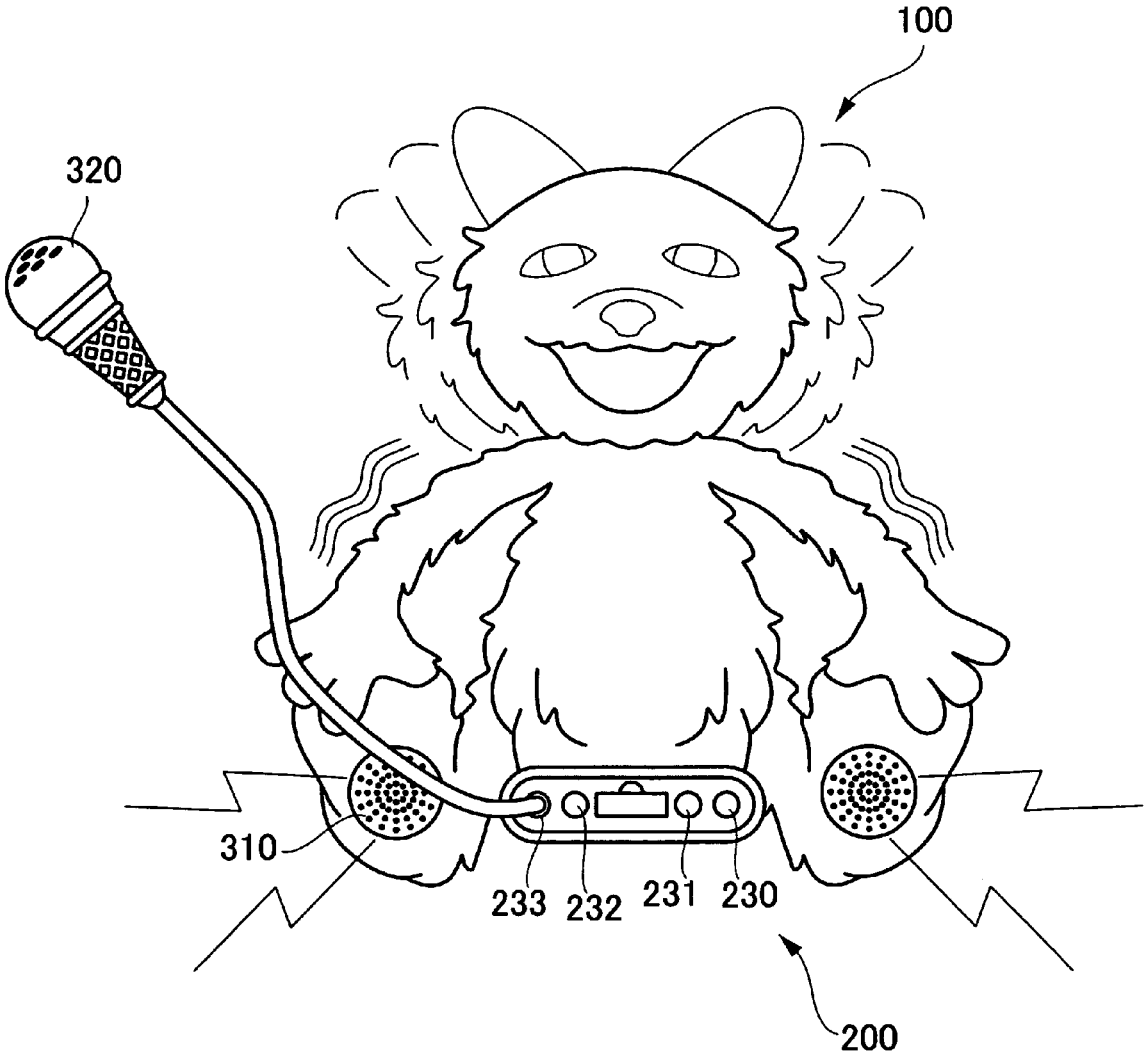
FIG. 1 is a front appearance view of a sounding toy of the invention.
Figure 2:
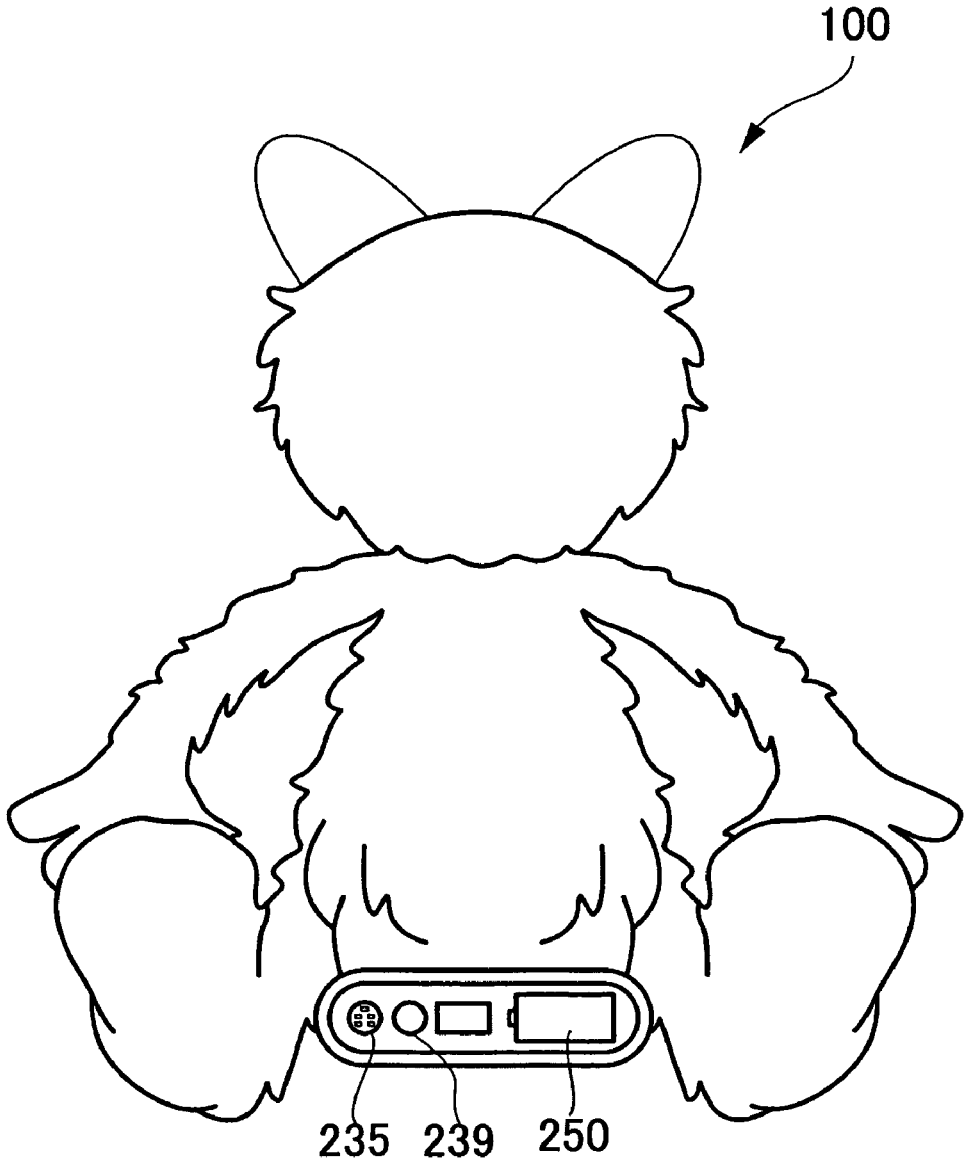
FIG. 2 is a rear appearance view of the sounding toy of the invention.

More specifically, as illustrated in FIG. 1, the invention consists of a toy 100 having a driving mechanism which utilizes a motor, a sound synthesizing device 200 which is formed of a casing and is integrated with the toy 100, and a sound mixing circuit which is provided in the interior of the sound synthesizing device, wherein a handy microphone 320 is connectable to a microphone terminal which is arranged on a front surface of the sound synthesizing device 200 exposed on the outside of the toy, and as illustrated in FIG. 2, a sound 10 source unit such as a CD player is connectable to an audio input terminal 235 which is arranged on a rear surface of the device exposed on the outside of the toy.

The outline of the toy 100 is made to imitate popular characters or animals, and it is formed by felt outer skin and cotton made from polyester etc. for inner thereof. Loudspeakers are incorporated into the foot parts as described later, thus the foot parts are made its direction to direct to the front forward of the toy so that the loud speaking direction from the loudspeaker may be a front direction of the toy. Also, 20 the toy 100 is stably placed like a sitting posture with hip and legs thereof.

Figure 3:
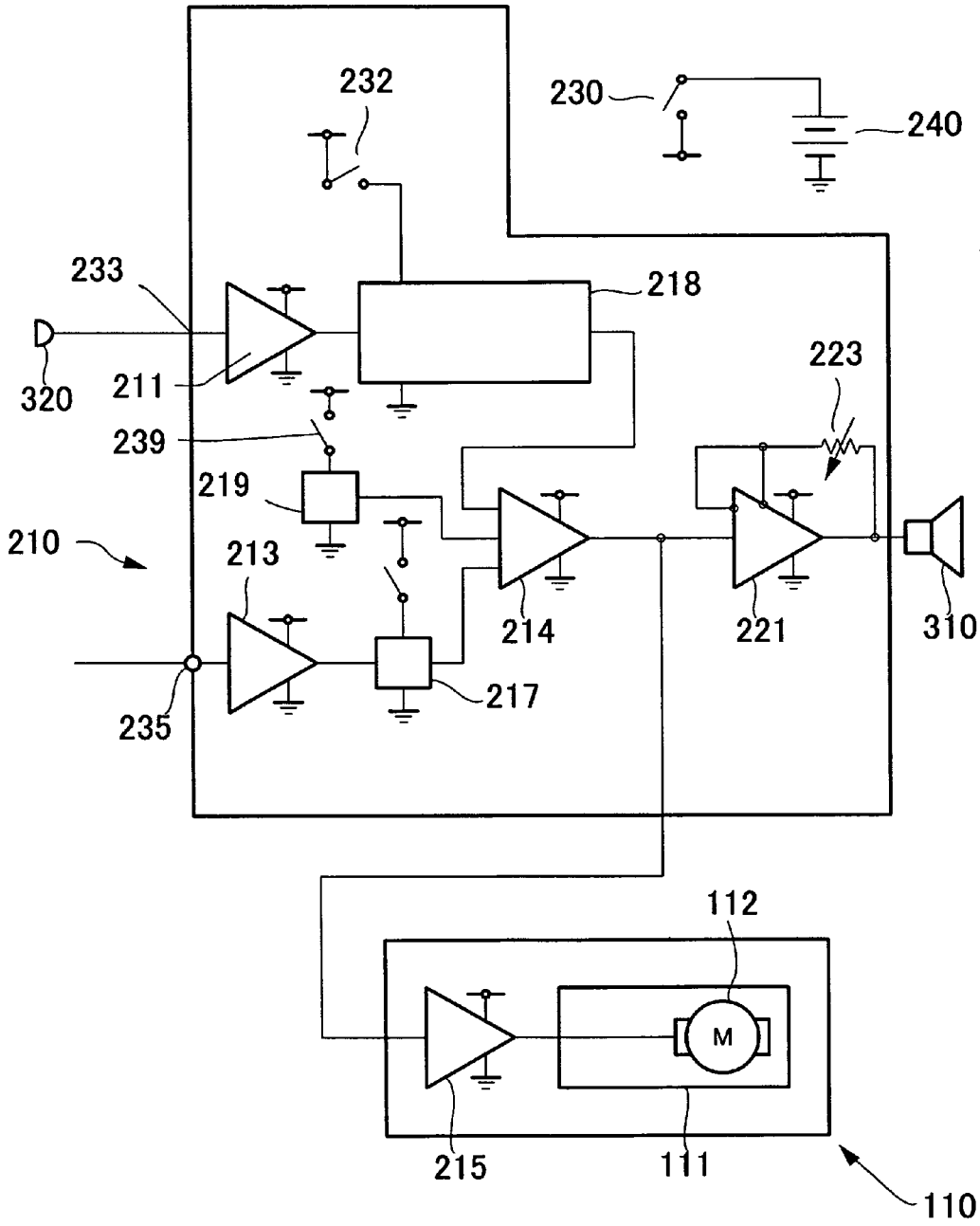
FIG. 3 is a circuit diagram of a sound mixing circuit of the invention.

A sound mixing circuit 210 is provided in the interior of the sound synthesizing device 200, as illustrated in FIG. 3, it consists of a first amplifier 211, a second amplifier 213, a mixer circuit 214, a vocal canceller 217, an effector 218 and a sound memory 219.

A voice of singer from a microphone 320 may be inputted as a sound analog signal from a microphone terminal 233 to the sound mixing circuit 210. The sound analog signal is amplified in the first amplifier 211 and the sound quality thereof is transformed in the effector 218.

On the other hand, an analog signal for accompaniment which is provided from CD player etc. being a sound source is inputted from the audio input terminal 235 to the sound mixing 10 circuit 210. The analog signal is amplified in the second amplifier 213 and an only sound signal which is a wavelength of human vocalization zone is deleted in the vocal canceller 217. In addition, a radio, a semiconductor memory, an audio instrument and a mobile phone which plays a ringer melody may be used as the sound source.

And the audio input terminal 235 is a small input terminal by using a pin jack such as an earphone jack and is able to connect to various analog signal generators which provide sound sources.

Furthermore, the mixer circuit 214 in the sound mixing circuit 210 is connected to the sound memory 219, the sound memory 219 provides a D/A translate circuit and a preamplifier in addition to a memory which stores a sound data for accompaniment of karaoke.

Therefore, ON/OFF of a voltage which is applied to the sound memory is controlled by switching of a memory switch 239, and it can be enjoyed karaoke without an external sound source.

And a singing voice to accompaniment can be recreated by two analog signals which are a voice of singer and accompaniment are superimposed in the mixer circuit 214. And this superimposed sound analog signal is outputted to a main amplifier 221, is outputted to a loudspeaker 310 after further amplifying and is audibly amplified from the loudspeaker 310.

An output side of the mixer circuit 214 is connected not only to the main amplifier 221 but also to a driver 215 of the driving mechanism 110, the sound analog signal which is superimposed in the mixer circuit 214 is inputted to the driver 215 too when it is inputted to the main amplifier and controls ON/OFF of a voltage for a motor 112, and the toy 100 is operated by the driving mechanism 110.

And as illustrated in FIG. 1, a main switch 230, a sound control switch 231 and an effect switch 232 are arranged on the front of the sound-synthesizing device 200.

The main switch 230 controls ON/OFF for supplying of electric power from a battery 240 to the sound mixing circuit 210 and the driving mechanism 110. The sound control switch 231 is connected to a volume 223 of the sound circuit 210, a resistance value of the volume 223 is changed by rotating the sound control switch 231, and then a current which is applied to main amplifier 221 is controlled.

Also the effect switch 232 controls ON/OFF for supplying of electric power to the effector 218, the sound has echo when the effector is ON, on the other hand, the sound analog signal is transmitted to the mixer circuit 214 without changing sound quality when the effector is OFF.

Also, as illustrated in FIG. 2, the memory switch 239 is arranged on the back of the sound synthesizing device 200.

The sound memory 219 is operated by handling the memory switch 239, and the sound such as music, applause and handclap may be outputted as the analog signal to the mixer circuit 214 based on a data which is stored in the memory of the sound memory 219.

And, loudspeakers 310 are incorporated into the each foot parts of the toy 100 and are connected to the main amplifier of the sound mixing circuit by wirings which are provided in the interior of the toy.

Accordingly, the loudspeaker 310 can be incorporated into the toy 100 with the driving mechanism etc. in the shape of the toy 100 as it is without a disadvantage such the shape of the toy 100 has to be changed when the loudspeaker 310 which is a relatively big part is incorporated into such as the main body.

Figure 4:
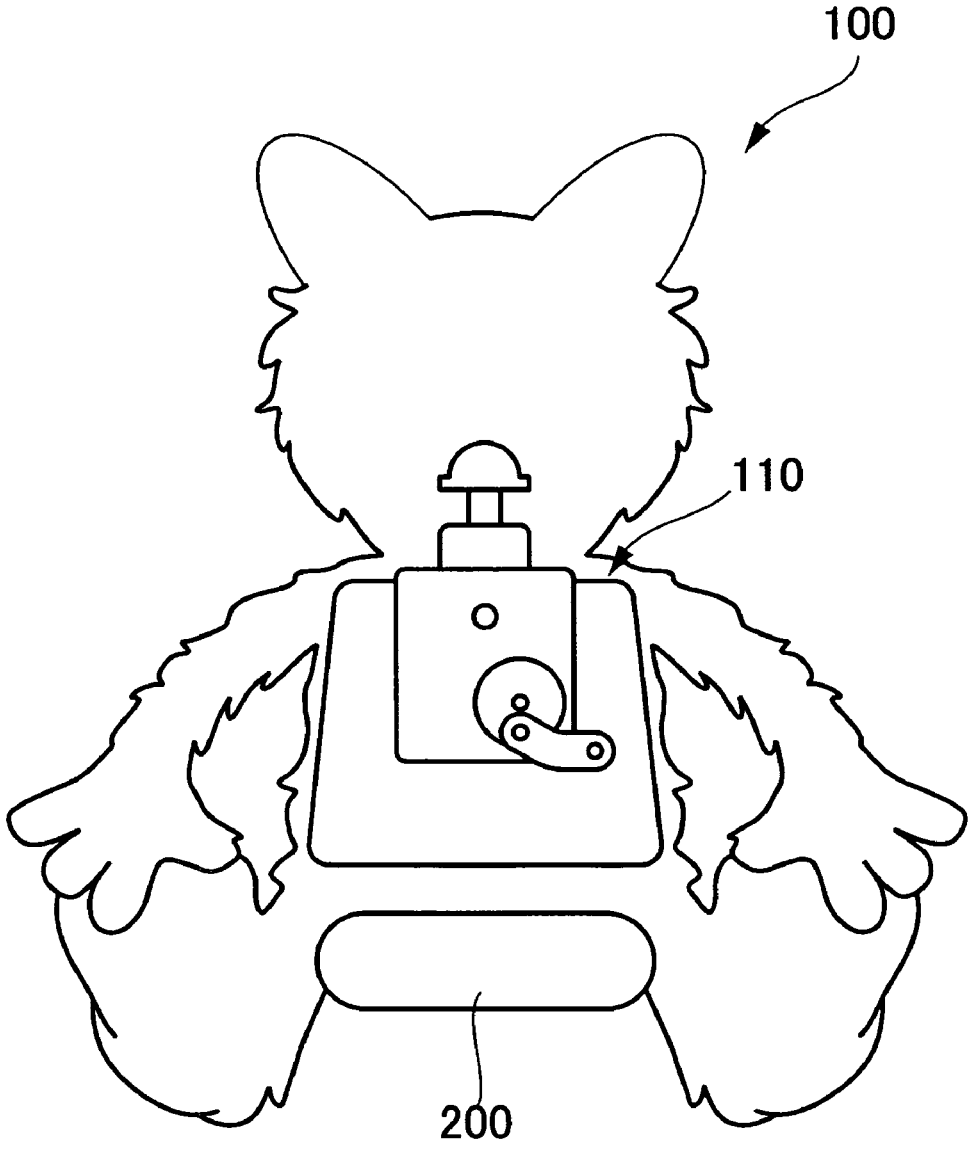
FIG. 4 is an interior construction view of the sounding toy of the invention.

As illustrated in FIG. 4, the driving mechanism 110 is placed in the interior of the body of the toy 100.

Figure 5:
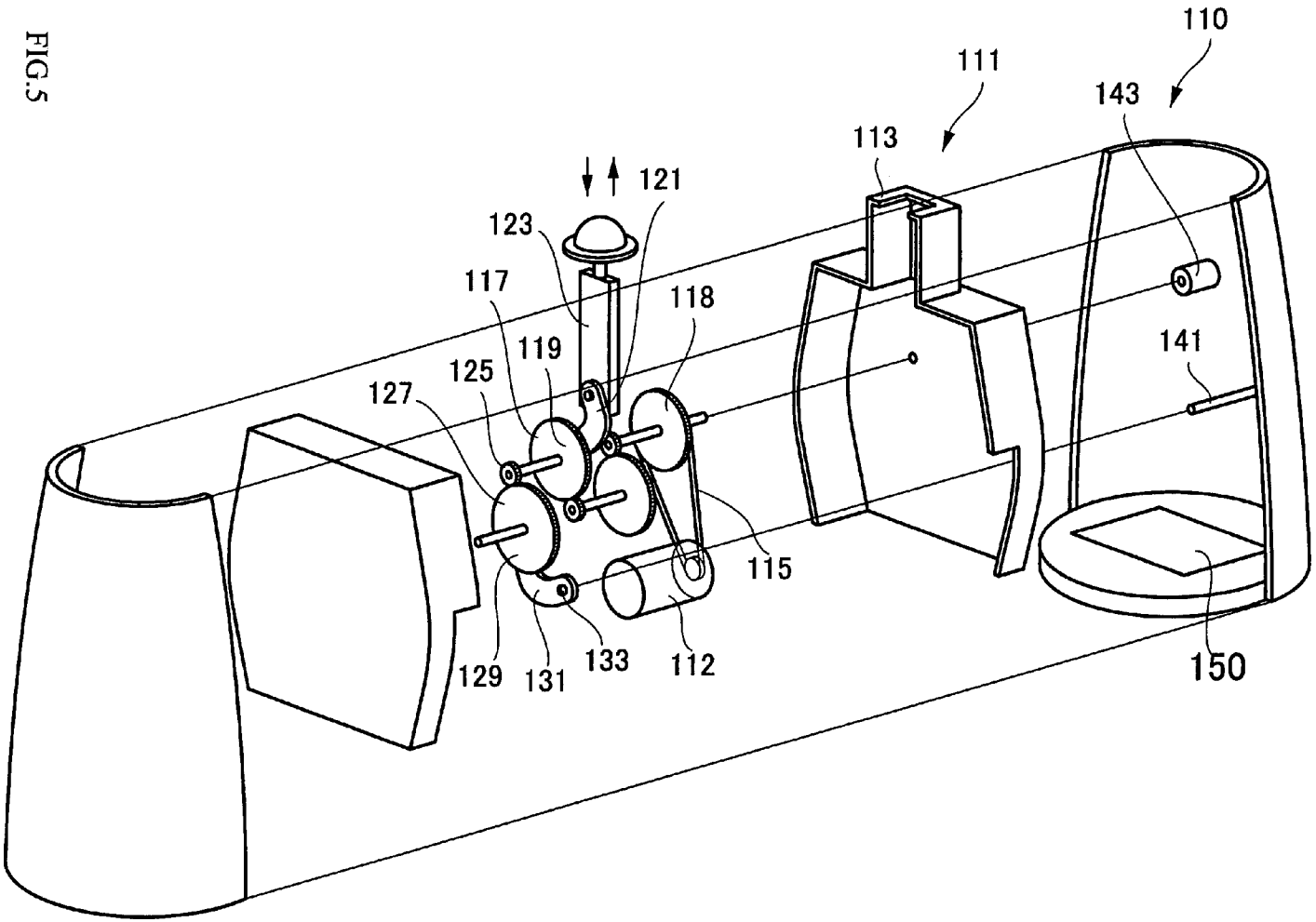
FIG. 5 is an exploded perspective view of a motion mechanism of the invention.

And as illustrated in FIG. 5, a rocking protrusion 143 which is provided in inner wall of the outer frame of the driving mechanism 110 and a rocking support part which is provided in about the center position of a rear face of a driving part 111 are rotatably jointed, thus the driving part 111 is rockably set to the outer frame of the driving mechanism 110.

The driving part 111 consists of a driving part body which inside is cavity, a motor 112 as a drive source which is placed in the inside of the driving part body, a speed reducing gear train which reduces a rotating of the motor 112 and a crank which transforms a rotational motion into a reciprocating motion.

Figure 6:
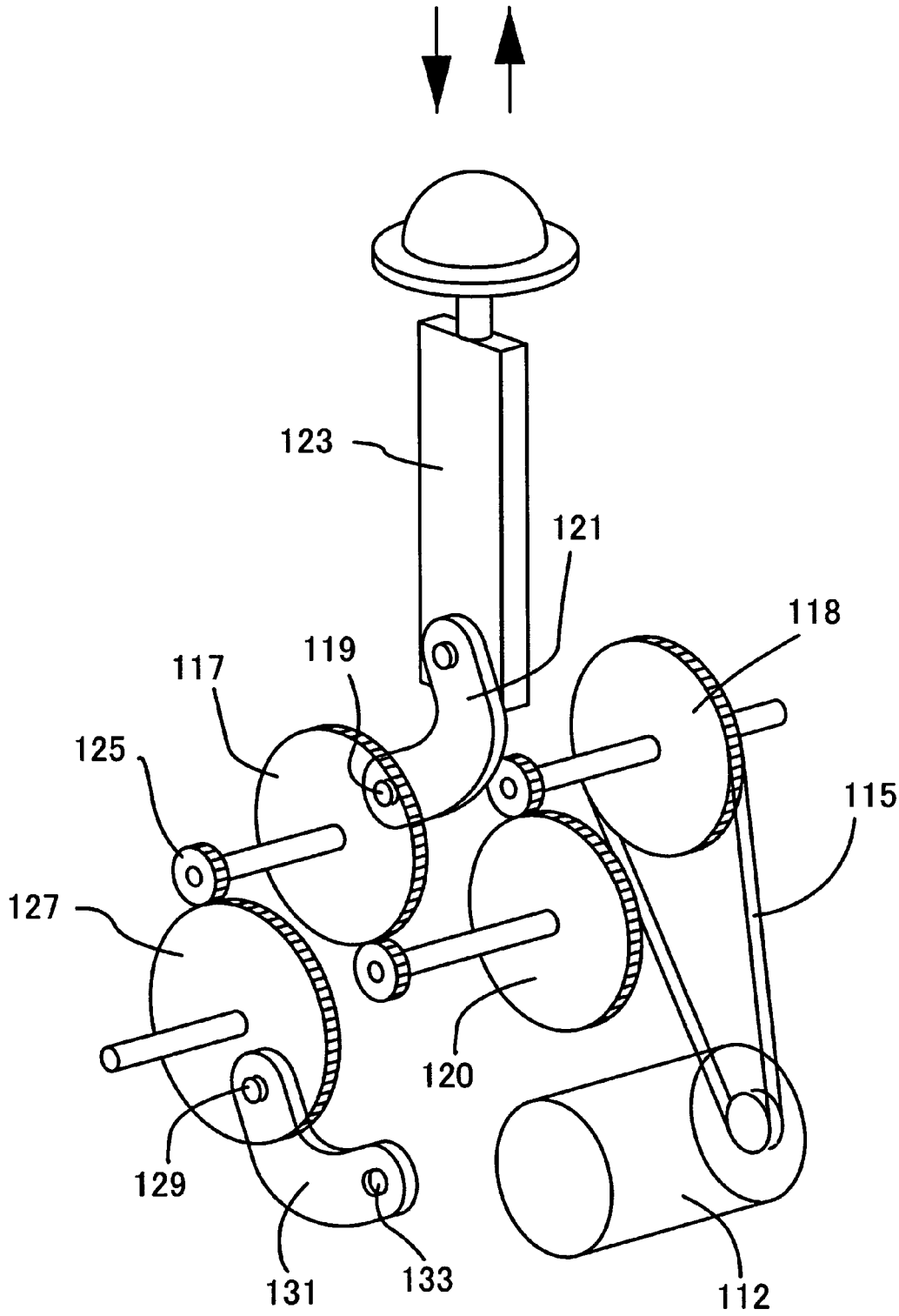
FIG. 6 is an exploded perspective view which shows a main part of the motion mechanism of the invention.

Regarding to the motor 112 which is set in the lower side of the driving part and the speed reducing gear train, as illustrated in FIG. 6, the rotation of the motor 112 can be transmitted to the speed reducing gear train by a pulley belt 115.

The speed reducing gear train consists of three speed reducing gears; wherein shaft positions of the first speed reducing gear 118 and the third speed reducing gear 17 are the same, but both shafts are separated and pivoted so as to differ their rotation number. On the other hand, a shaft position of the second speed reducing gear 120 is differ from shaft positions of other two speed reducing gears, and it is rotatably pivoted on the lower side of shafts of the first speed reducing gear 118 and the third speed reducing gear 117.

The first speed reducing gear 118 is connected to the motor 112 by the pulley belt 115, a pinion of the first speed reducing gear 118 is engaged with a gear wheel of the second speed reducing gear 120, and a pinion of the second speed reducing gear 120 is engaged with a gear wheel of the third speed reducing gear 117.

An eccentric protrusion 119 is provided in a position positioned eccentrically from a rotation center of a flat surface of the gear wheel of the third speed reducing gear 117, one rotary hole of a crank rod 121 which rotary holes are made on both ends is rotatably connected to the eccentric protrusion 119. Also, a rotary hole of another end of the crank rod 121 is rotatably connected to a protrusion which is projected on the bottom end of a piston rod 123.

Furthermore, as illustrated in FIG. 5, the piston rod 123 is slidably inserted in the inside of a cylinder 113 which is formed in a stopping part of the driving part.

A shaft position of a spur gear 127 which is engaged with the pinion of the third speed reducing gear and a shaft position of the second speed reducing gear 120 are the same, but both shafts are separated and pivoted so as to differ their rotation number.

And, an eccentric protrusion 129 is provided in a position positioned eccentrically from a rotation center of a flat surface of the spur gear 127, one rotary hole of a crank rod 131 which rotary holes are made on both ends is rotatably connected to the eccentric protrusion 129. Also a rotary hole of another end of the crank rod 131 is, as illustrated in FIG. 5, rotatably jointed with a rocking support protrusion 141 which is projected on the inner wall of the outer frame of the driving mechanism 110.

In this driving mechanism, a driver applies a direct voltage of battery to the motor 112 and makes it rotate when the analog signal from the mixer circuit is inputted to the driver. The rotation of the motor is transmitted to the speed reducing gear train through the pulley belt 115. And the rotation is transmitted to the third speed reducing gear 117 through two speed reducing gears of the speed reducing gear train, the rotation of the third speed reducing gear 117 is transformed into a piston motion through the crank rod 121 and a piston rod 123 is moved up and down such as the piston rod 123 makes the piston motion in the inside of the cylinder 113 since the eccentric protrusion 119 which is projected on the flat surface of the third speed reducing gear 117 is rotatably connected to one end of the crank rod 121 and another end of the crank rod 121 is rotatably connected to the piston rod 123.

Figure 7:
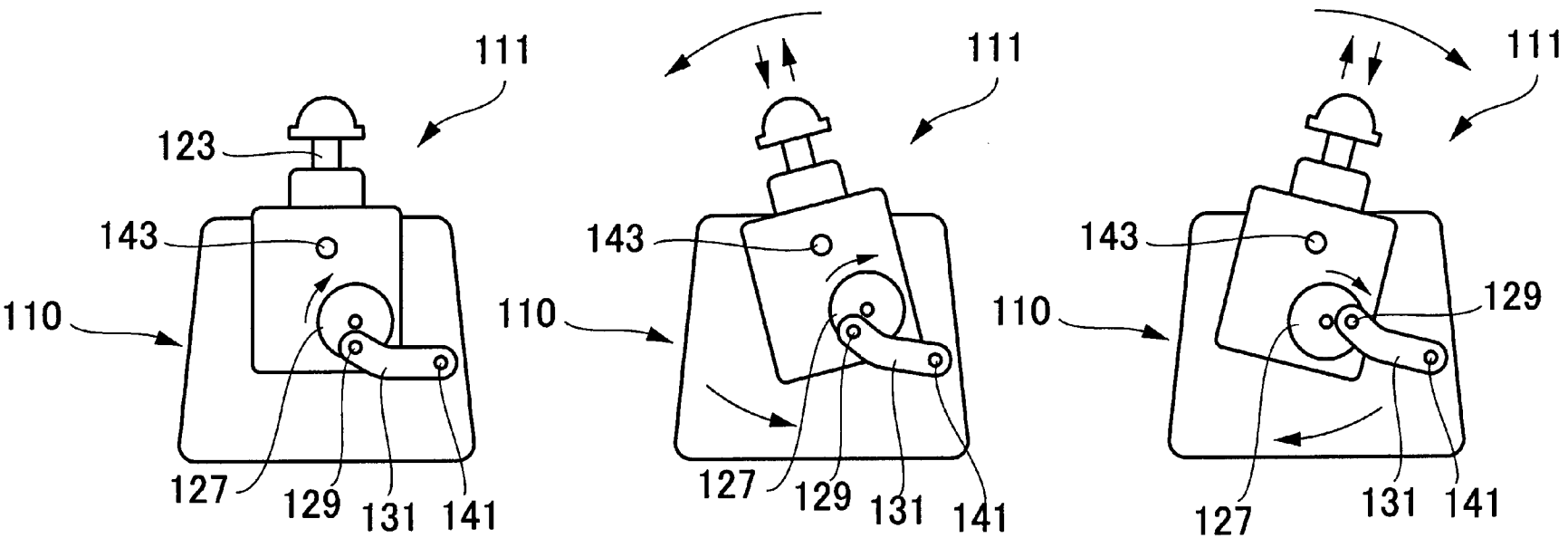
FIG. 7 is a drawing which shows an operation of the motion mechanism of the invention.

Also, the rotation of the third speed reducing gear 117 is transmitted to the spur gear 127 by reducing the speed since the pinion 125 which has the same shaft as the third speed reducing gear 117 is engaged with the spur gear 127. The rotational motion of the spur gear 127 is transformed into a rocking motion through the crank rod 131, since the eccentric protrusion 129 projected on the flat surface of the spur gear 127 is rotatably connected to one end of the crank rod 131, a rocking support hole 133 made on another end of the crank rod 131 is rotatably connected to a rocking support protrusion 141 projected in the inner wall of the outer frame of the driving mechanism 110, and the driving part 111 is slidably set to the outer frame of the driving mechanism 110. Therefore, as illustrated in FIG. 7, the driving part 111 can be rocked to the driving mechanism 110 by the crank rod 131 alternately repeating press and pull to the rocking support protrusion 141.

The cycle of piston motion of the crank rod 131 is larger than the cycle of piston motion of the piston rod 123 since the rotation is reduced through the pinion 125 which is placed on the same shaft of the third speed reducing gear 117. That is to say, the cycle of piston motion of the piston rod 123 is smaller than the cycle of rocking of the driving part 111. Therefore, the movement of the toy 100 to the music can be more interesting since the timing of the cycle of swinging head of the toy 100 in the lateral direction and the movement of tapping rhythm up and down is different.

Figure 8:
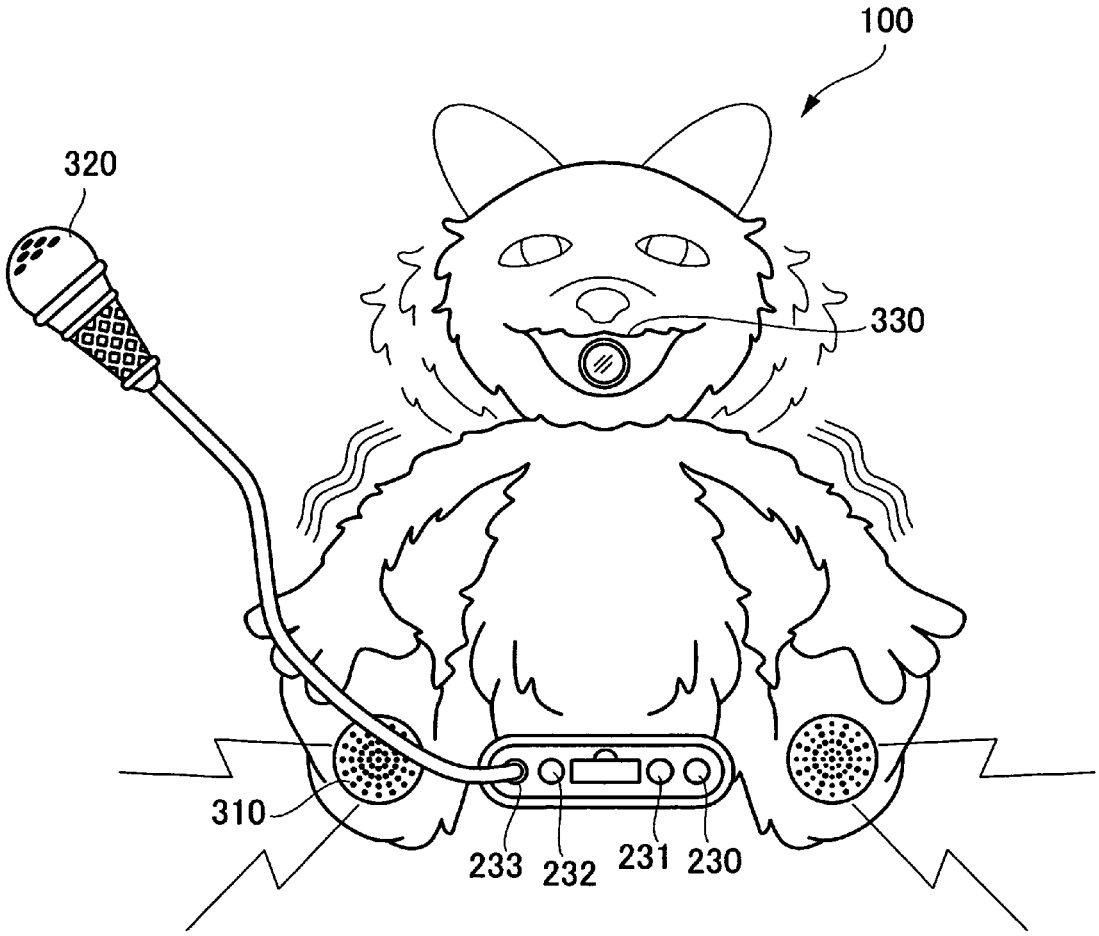
FIG. 8 is a front appearance view of a sounding toy showing another embodiment of the invention.
Figure 9:
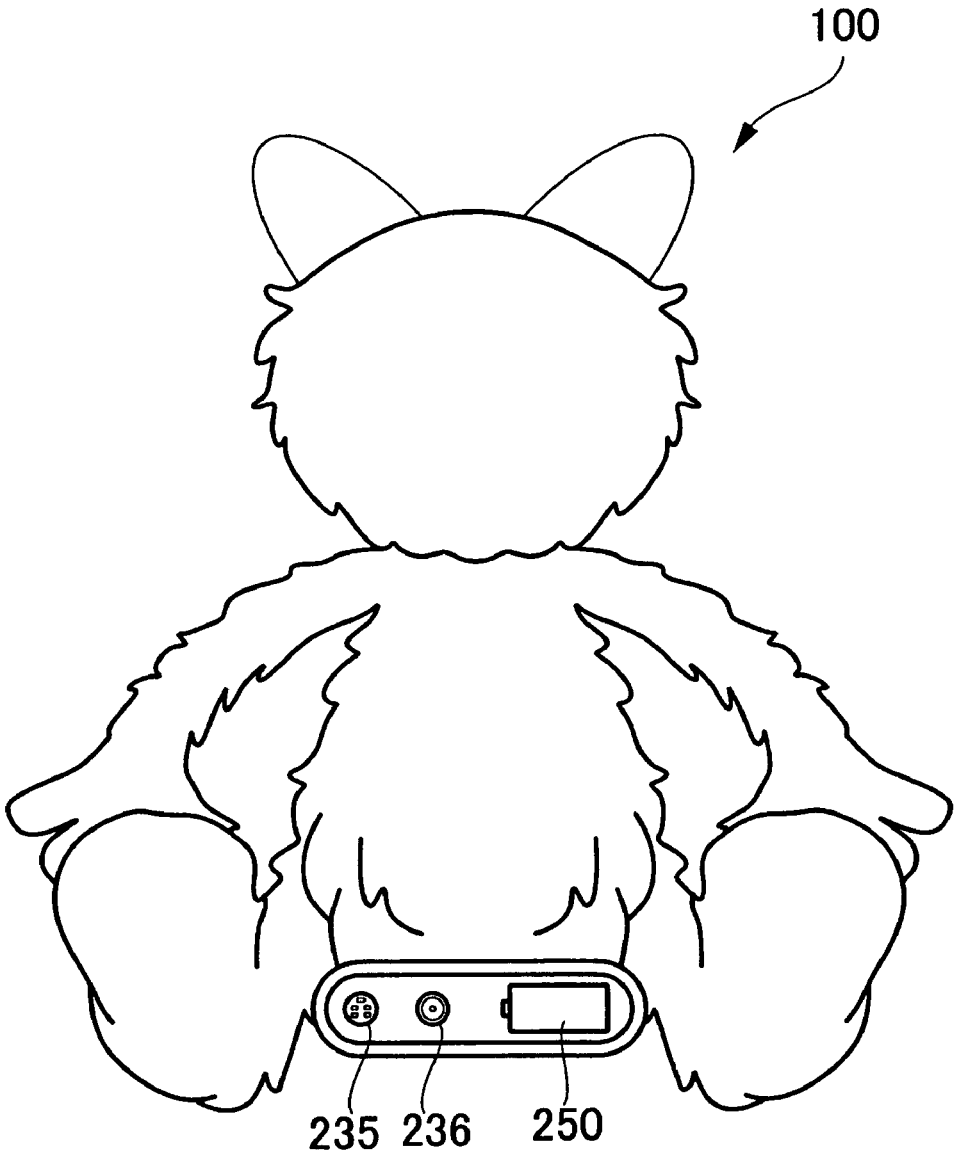
FIG. 9 is a rear appearance view of the sounding toy showing another embodiment of the invention.

As illustrated in FIG. 8, a CCD camera 330 as an imaging device can be placed in the oral part of the toy 100. In this case, as illustrated in FIG. 9, a video output terminal 236 is arranged on the rear surface of the sound-synthesizing device 200.

Figure 10:
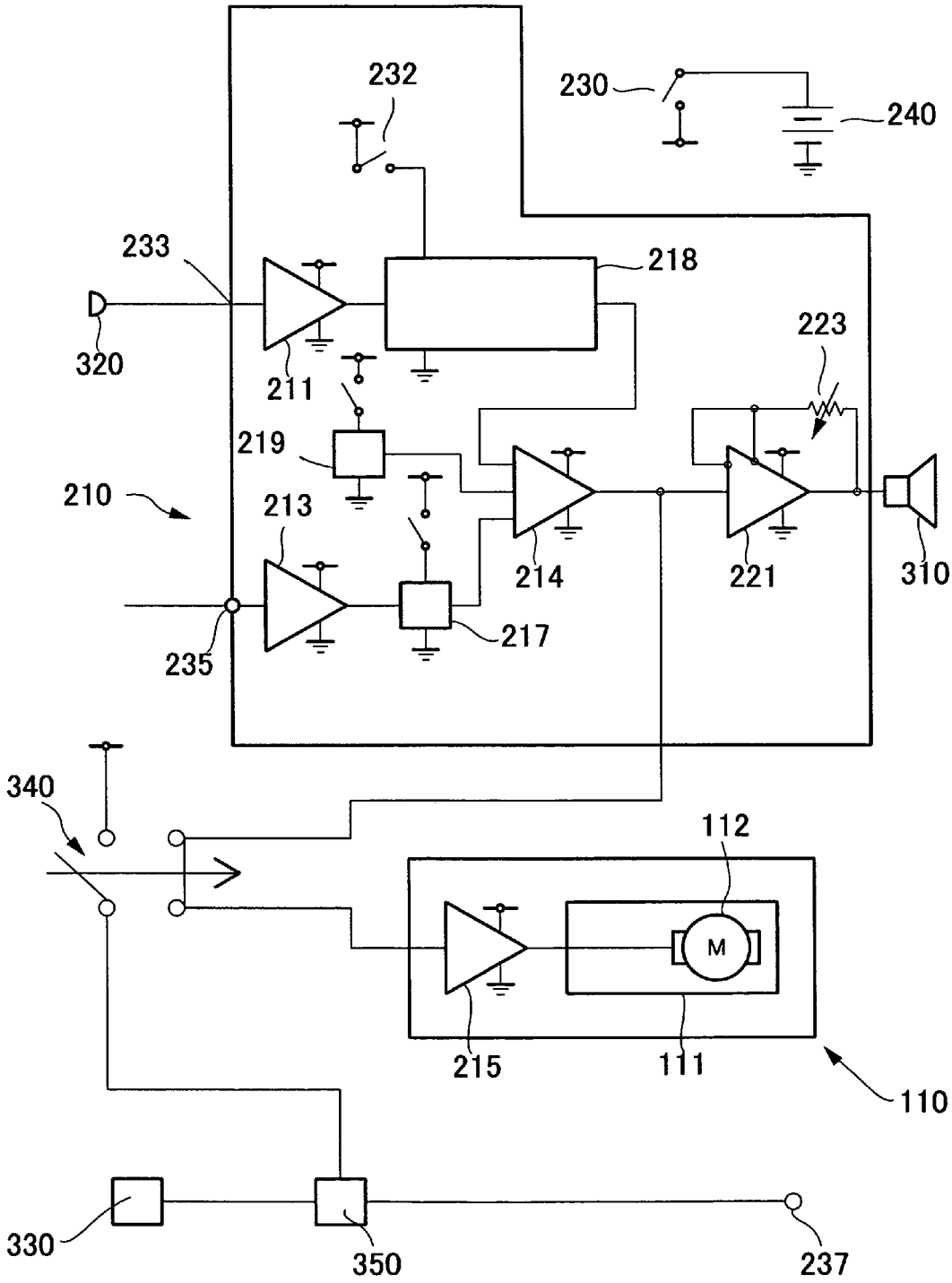
FIG. 10 is a circuit diagram of a sound mixing circuited etc. of another embodiment of the invention.

As illustrated in FIG. 10, the signal from the CCD camera 330 is transformed to a video signal in a video signal forming circuit 350, a video output circuit outputting to a monitor is provided in the video output terminal 236 which is arranged on the rear surface of the sound synthesizing device 200. Therefore, the images can be displayed on the monitor.

Accordingly, the mood of karaoke can be more aroused since a figure of singer etc. maybe projected into the imaging device.

In this case, as illustrated in FIG. 10, an interlock switch 340 can be provided to make applying of a voltage to the driving mechanism 110 OFF when the CCD camera 330 is ON so that the image may not swing in the lateral direction when the toy 100 moves in the lateral direction.

In addition, the CCD camera 330 can be placed in the abdomen part of the toy which has lesser movement.

Figure 11:
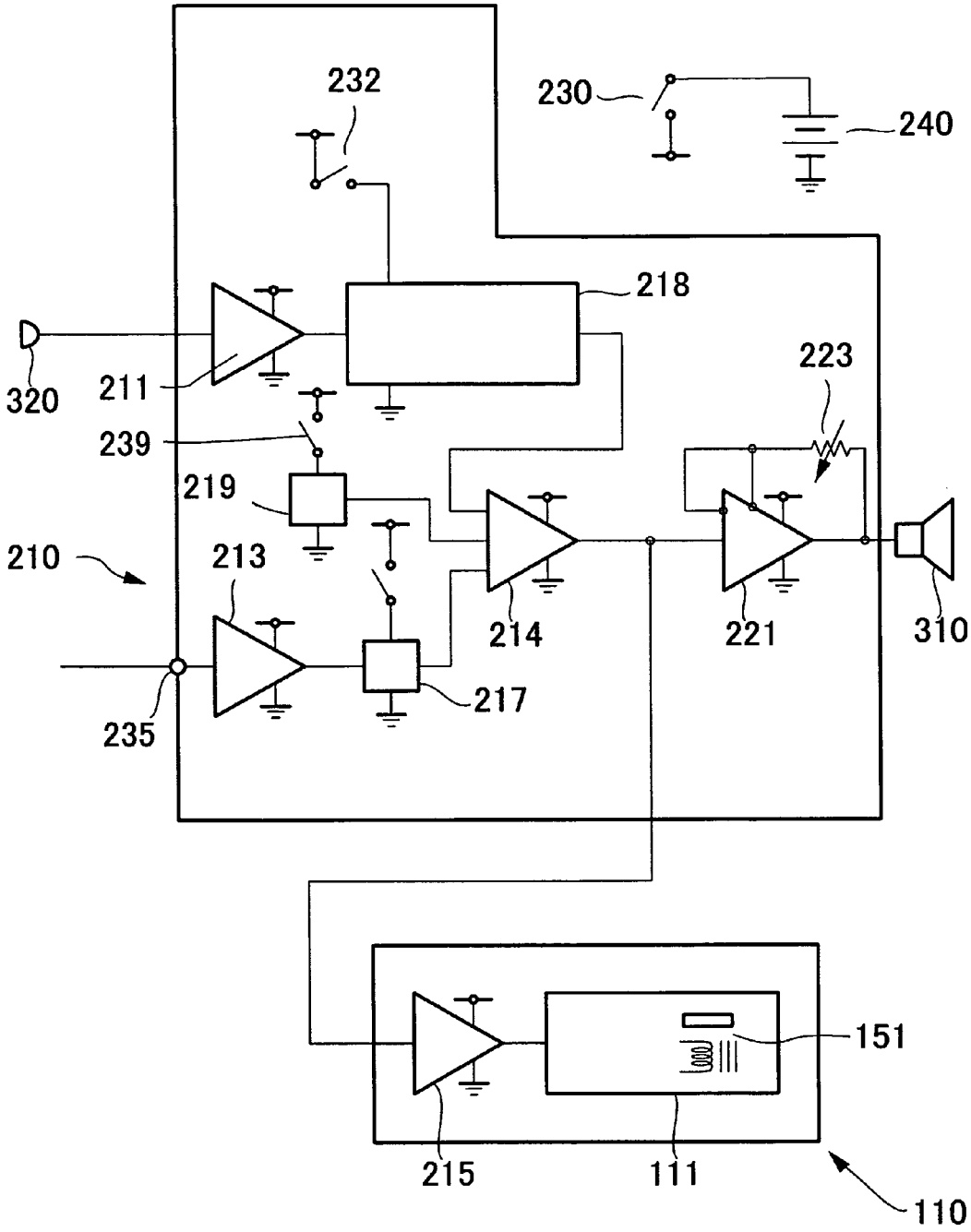
FIG. 11 is a circuit diagram of the sound mixing circuit of another embodiment of the invention.

And as illustrated in FIG. 11, a solenoid unit 151 may be used as a power mechanism, the signal from the driver is transformed to an interrupted signal and is applied to the solenoid unit 151 and moves the toy 100 by using a piston rod etc. by rocking a moving piece.

INDUSTRIAL APPLICABILITY

As described above, this invention has an advantage which can provide a never boring toy which moves to the singing voice or accompaniment music and which people can enjoy karaoke.

The invention claimed is:

1. A sounding toy comprising a driving mechanism which has a sound mixing circuit and loudspeakers in the interior thereof and has a microphone terminal which can make a microphone connect to the sound mixing circuit and an audio terminal which can make an analog signal generator connect to the sound mixing circuit; wherein in the sound mixing circuit, a sound analog signal inputted from the microphone terminal is amplified in a first amplifier and an analog signal inputted from the audio terminal is amplified in a second amplifier, and then above two analog signals are superimposed in a mixer circuit and are amplified from the loudspeaker through an output-controllable main amplifier, the driving mechanism comprising a motor as a drive source, a speed reducing gear train which reduces a rotating of the motor, a crank which transforms a rotational motion into a reciprocating motion and a movable part connected to the crank to sway by the reciprocating motion, an output terminal of the mixer circuit is connected to a driver as well as to the main amplifier, the driver applies a voltage to the motor of the driving mechanism when the analog signals are inputted from the mixer circuit and the movable part is swayed by the driving mechanism.

2. The sounding toy of claim 1, wherein a vocal canceller is provided in between the second amplifier and the mixer circuit.

3. The sounding toy of claim 2, wherein an effector is provided in between the first amplifier and the mixer circuit.

4. The sounding toy of claim 3, wherein the loudspeaker is put into foot parts of the toy.

5. The sounding toy of claim 4, wherein an imaging device and the video signal forming. circuit are incorporated into the toy, the video signal forming circuit outputs the picture signal inputted from the imaging device to the monitor terminal as the video signal.

6. The sounding toy of claim 5, wherein the sound mixing circuit has a sound memory.

7. The sounding toy of claim 5, wherein an audio data such as the character's voice, applause and handclap is stored in the sound memory.

8. The sounding toy of claim 4, wherein the sound mixing circuit has a sound memory.

9. The sounding toy of claim 4, wherein an audio data such as the character's voice, applause and handclap is stored in the sound memory.

10. The sounding toy of claim 3, wherein an imaging device and the video signal forming circuit are incorporated into the toy, the video signal forming circuit outputs the picture signal inputted from the imaging device to the monitor terminal as the video signal.

11. The sounding toy of claim 10, wherein the sound mixing circuit has a sound memory.

12. The sounding toy of claim 11, wherein an audio data such as the character's voice, applause and handclap is stored in the sound memory.

13. The sounding toy of claim 10, wherein an audio data such as the character's voice, applause and handclap is stored in the sound memory.

14. The sounding toy of claim 3, wherein the sound mixing circuit has a sound memory.

15. The sounding toy of claim 3, wherein an audio data such as the character's voice, applause and handclap is stored in the sound memory.

16. The sounding toy of claim 2, wherein the loudspeaker is put into foot parts of the toy.

17. The sounding toy of claim 16, wherein an imaging device and the video signal forming circuit are incorporated into the toy, the video signal forming circuit outputs the picture signal inputted from the imaging device to the monitor terminal as the video signal.

18. The sounding toy of claim 17, wherein the sound mixing circuit has a sound memory.

19. The sounding toy of claim 17, wherein an audio data such as the character's voice, applause and handclap is stored in the sound memory.

20. The sounding toy of claim 16, wherein the sound mixing circuit has a sound memory.

21. The sounding toy of claim 2, wherein an imaging device and the video signal forming circuit are incorporated into the toy, the video signal forming circuit outputs a picture signal inputted from the imaging device to the monitor terminal as the video signal.

22. The sounding toy of claim 21, wherein the sound mixing circuit has a sound memory.

23. The sounding toy of claim 22, wherein an audio data such as the character's voice, applause and handclap is stored in the sound memory.

24. The sounding toy of claim 21, wherein an audio data such as the character's voice, applause and handclap is stored in the sound memory.

25. The sounding toy of claim 2, wherein the sound mixing circuit has a sound memory.

26. The sounding toy of claim 25, wherein an audio data such as the character's voice, applause and handclap is stored in the sound memory.

27. The sounding toy of claim 2, wherein an audio data such as the character's voice, applause and handclap is stored in the sound memory.

28. The sounding toy of claim 1, wherein an effector is provided in between the first amplifier and the mixer circuit.

29. The sounding toy of claim 28, wherein the loudspeaker is put into foot parts of the toy.

30. The sounding toy of claim 28, wherein an imaging device and the video signal forming circuit are incorporated into the toy, the video signal forming circuit outputs the picture signal inputted from the imaging device to the monitor terminal as the video signal.

31. The sounding toy of claim 30, wherein the sound mixing circuit has a sound memory.

32. The sounding toy of claim 30, wherein an audio data such as the character's voice, applause and handclap is stored in the sound memory.

33. The sounding toy of claim 28, wherein the sound mixing circuit has a sound memory.

34. The sounding toy of claim 33, wherein an audio data such as the character's voice, applause and handclap is stored in the sound memory.

35. The sounding toy of claim 28, wherein an audio data such as the character's voice, applause and handclap is stored in the sound memory.

36. The sounding toy of claim 1, wherein the loudspeaker is put into foot parts of the toy.

37. The sounding toy of claim 36, wherein an imaging device and the video signal forming circuit are incorporated into the toy, the video signal forming circuit outputs the picture signal inputted from the imaging device to the monitor terminal as the video signal.

38. The sounding toy of claim 36, wherein the sound mixing circuit has a sound memory.

39. The sounding toy of claim 38, wherein an audio data such as the character's voice, applause and handclap is stored in the sound memory.

40. The sounding toy of claim 36, wherein an audio data such as the character's voice, applause and handclap is stored in the sound memory.

41. The sounding toy of claim 1, wherein an imaging device and a video signal forming circuit are incorporated into the toy, the video signal forming circuit outputs a picture signal inputted from the imaging device to a monitor terminal as a video signal.

42. The sounding toy of claim 1, wherein the sound mixing circuit has a sound memory.

43. The sounding toy of claim 1, wherein an audio data such as a character's voice, applause and handclap is stored in the sound memory.

* * * * *